US006178565B1

(12) United States Patent
Franco

(10) Patent No.: US 6,178,565 B1
(45) Date of Patent: Jan. 30, 2001

(54) TRASH COLLECTOR FOR EXFILTRATION DRAIN SYSTEM

(76) Inventor: Jose Franco, 8370 NW. 10 Street, Unit 12 Miami, FL (US) 33126

( * ) Notice: Under 35 U.S.C. 154(b), the term of this patent shall be extended for 0 days.

(21) Appl. No.: 09/479,002

(22) Filed: Jan. 7, 2000

(51) Int. Cl.[7] ..... E03C 1/26
(52) U.S. Cl. ..... 4/291; 4/289; 210/163
(58) Field of Search ..... 4/286, 292; 210/163, 210/164

(56) References Cited

U.S. PATENT DOCUMENTS 1,035,733 * 8/1912 Pierce ..... 4/289
2,505,305 * 4/1950 Schaefer ..... 4/289
4,321,713 3/1982 Thompson ..... 4/290
5,130,016 * 7/1992 Gavin ..... 210/164
5,284,580 * 2/1994 Shyh ..... 4/286 X
5,397,464 * 3/1995 Hannon ..... 4/288 X

* cited by examiner

*Primary Examiner*—Charles E. Phillips
(74) *Attorney, Agent, or Firm*—J. Sanchelima

(57) ABSTRACT

A drain assembly with a shaft that has an enlarged shoulder at its upper end supports a basket assembly by providing a peripheral resting surface for peripheral flange members that extend outwardly from the connected upper end of the mesh walls forming the basket. A bar member used as a handle is rigidly mounted within the basket's cavity longitudinally therein. A grill cover assembly in removably mounted within the peripheral shoulder sandwiching the flange members.

7 Claims, 2 Drawing Sheets

TRASH COLLECTOR FOR EXFILTRATION DRAIN SYSTEM

BACKGROUND OF THE INVENTION

1. Field of the Invention

The present invention relates to a trash collector for drain systems, and more particularly, to a collector that is readily removable.

2. Description of the Related Art

Applicant believes that the closest reference corresponds to U.S. Pat. No. 4,321,713 issued to Thompson in 1982. However, it differs from the present invention because in Thompson's patent, the drainage receptacle includes a strainer basket and a cover plate that mounts on a flange, this flange is connected to a receptacle body. This device lacks a bar for the removal and placement of the basket.

In a typical drain system, an opening is covered with lateral walls defining a shaft and the upper end of the opening is enlarged to provide a peripheral supporting area where a cast iron grid rests. Debris accumulates in the shaft causing the system to clog, requiring expensive excavation and maintenance work. The present invention resolves the problem by collecting the debris before it clogs and damages the drain system.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a trash collector for drain systems that is readily removable so that the debris that is collected can be easily disposed of.

It is another object of this invention to provide a trash collector that is compatible with existing drain structures.

It is still another object of the present invention to provide a trash collector that does not alter the protruding physical structure of the drain system.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
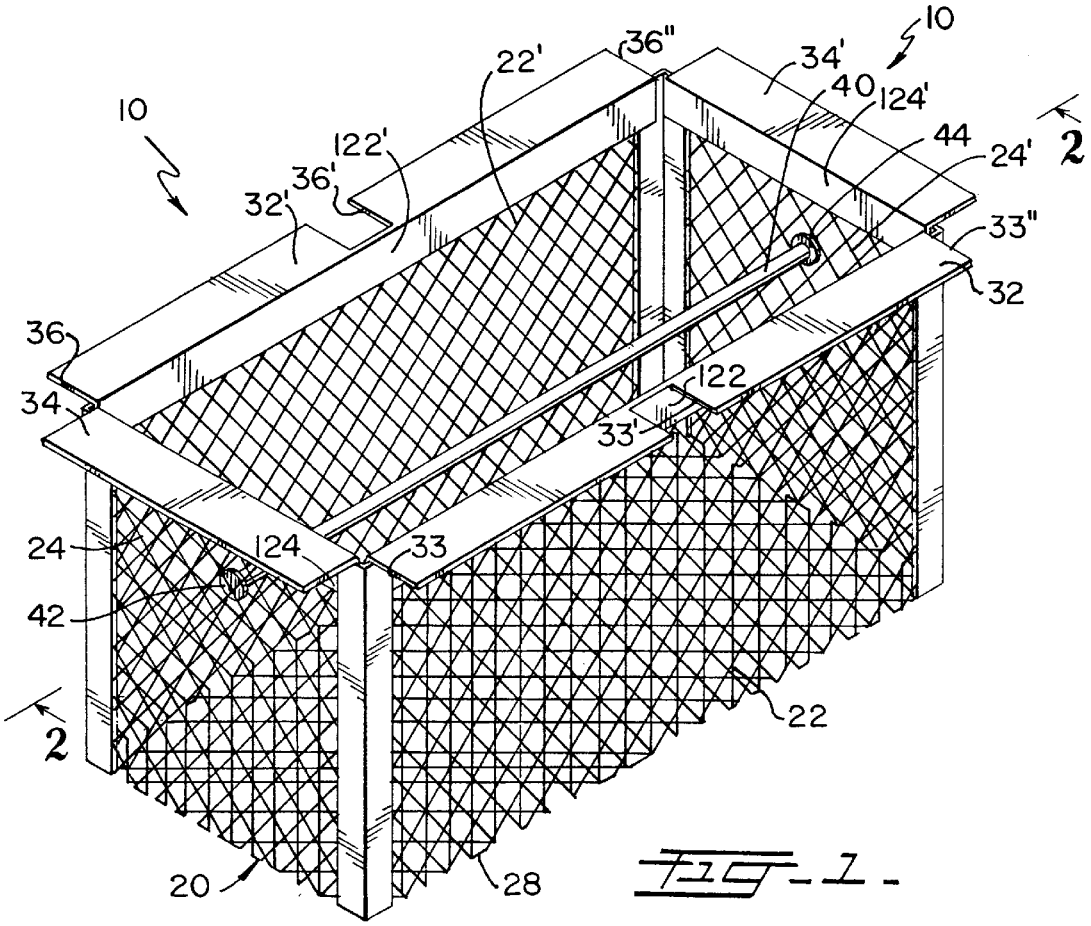
FIG. 1 represents an isometric view of the trash collector.
Figure 2:
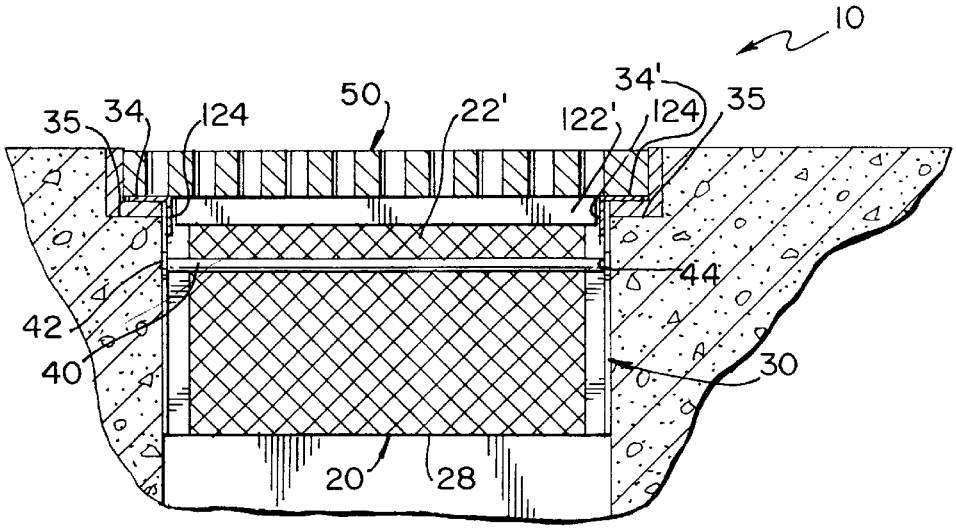
FIG. 2 shows a cross sectional view of the invention taken along line 2—2 in FIG. 1 and inserted in the drain system.
Figure 3:
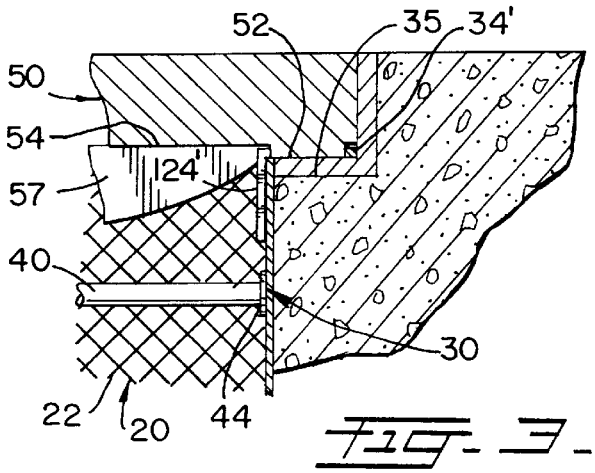
FIG. 3 illustrates a partial cross sectional view taken from line 3—3 in FIG. 4, showing the position of the trash collector's corner when it is installed in a drain system.

Referring now to the drawings, where the present invention is generally referred to with numeral 10, it can be observed that it basically includes a basket assembly 20 that has two long peripheral walls 22 and 22' and two small peripheral walls 24 and 24' perpendicularly mounted on the peripheral edge of rectangular bottom member 28. Walls 22; 22'; 24 and 24' and bottom member 28 are made out of a meshed material, preferably steel, or any other material that is corrosion resistant, such as aluminium.

The upper edges 122; 122'; 124 and 124' of walls 22; 22'; 24 and 24' are reinforced and include perpendicularly and outwardly extending flange members 32; 32'; 34; and 34', respectively.

Bar member 40 is used as a handle and is rigidly mounted within the basket's assembly. Bar member 40 includes two ends, 42 and 44, that connect perpendicularly to walls 24 and 24' at a predetermined distance below flange members 34 and 34'.

In a typical drain system, a shaft assembly 30 comprises four shaft walls perpendicular to each other that extend vertically. The upper end of shaft 30 includes a peripheral shoulder 35 that is parallel to and below the ground where the drain system is installed. Flange members 32; 32'; 34 and 34' rest on peripheral shoulder 35. Grill cover assembly 50 has cooperative dimensions to be received within said peripheral shoulder 35 sandwiching flange members 32; 32'; 34 and 34'.

Figure 4:
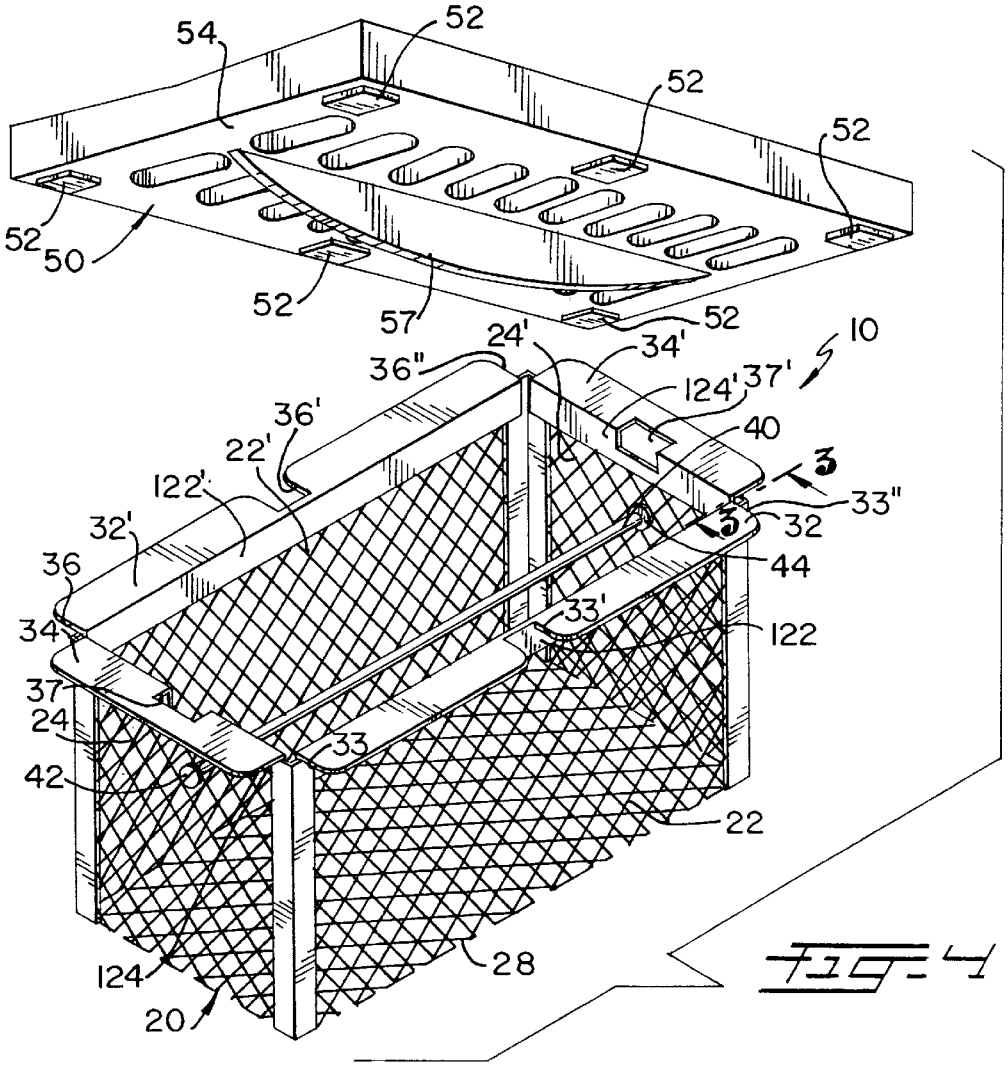
FIG. 4 is an exploded view of an alternate trash collector with the cast iron grid being installed.

As it can be best seen in FIG. 4, conventional grill cover assembly 50 includes six pads 52 on underside 54 to keep it slightly raised. Flange members 32 and 32' include cutouts 33; 33' and 33"; 36; 36' and 36", respectively, that have cooperative dimensions to permit pads 52 to go through and rest on shoulder 35. Cover assembly 50 also includes a longitudinally central rib member 57 on underside 54. Flange members 34 and 34' include centrally positioned cutouts 37 and 37', respectively, to permit rib member 57 to go through.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A drain assembly, comprising:

A) a vertical opening having four shaft walls perpendicular to each other defining a shaft with a rectangular cross-section and a common upper peripheral shoulder at a parallel and spaced apart relationship with respect to a horizontal ground level where said drain assembly is located;

B) a basket assembly having four mesh walls smaller that said shaft walls, said mesh walls being also perpendicularly mounted to each other and further including a bottom mesh wall so that a cavity is defined therein for collecting debris, and each of said mesh walls includes an upper edge connected to each other and further including an outwardly extending flange member for each of said upper edges, said flange members being in one plane, and said outwardly extending flange members having cooperative dimensions to be supported by said peripheral shoulder and removably positioned thereon; and said basket assembly includes a bar member with two ends mounted inside said cavity below said flange members, said ends mounted, respectively, to opposite mesh walls; and C) a grill cover assembly having cooperative dimensions to be received within said peripheral shoulder and being removably mounted over said flange members.

2. The drain assembly set forth in claim 1 wherein said bar member is centrally and longitudinally mounted to two opposite mesh walls and adjacent to said flange members.

3. The drain assembly set forth in claim 2 wherein said peripheral shoulder is made out of unitary piece.

4. The drain assembly set forth in claim 3 wherein the said mesh walls define four corners and further including a reinforcement member for each of said corners.

5. The drain assembly set forth in claim 4 wherein said mesh walls and reinforcement members are made out of steel.

6. The drain assembly set forth in claim 5 wherein said grill cover assembly includes an underside having a plurality of pads and said flange members including a corresponding plurality of first cutouts so that said pads go through and are supported by said peripheral shoulder.

7. The drain assembly set forth in claim 6 wherein said grill cover assembly includes a longitudinal rib member with two ends and said flange members including second cutouts so that said ends go through and are supported by said peripheral shoulder.

* * * * *